United States Patent [19]

Athy, Jr.

[11] 4,036,106

[45] July 19, 1977

[54] ACTUATOR CONTROL SYSTEM

[75] Inventor: Lawrence F. Athy, Jr., Houston, Tex.

[73] Assignee: Southwestern Manufacturing Co., Tex.

[21] Appl. No.: 564,647

[22] Filed: Apr. 3, 1975

[51] Int. Cl.[2] ..... F15B 13/042; F15B 21/00

[52] U.S. Cl. ..... 91/5; 60/403; 60/413; 91/29; 91/420; 91/433; 91/442

[58] Field of Search ..... 91/5, 420, 442, 433, 91/29; 60/403, 404, 413; 251/26

[56] References Cited

U.S. PATENT DOCUMENTS

| | | | |
|---|---|---|---|
| 2,900,960 | 8/1959 | Gratzmuller | 91/442 X |
| 2,943,604 | 7/1960 | Chubb | 91/461 X |
| 3,142,315 | 7/1964 | Hennells, Sr. | 137/625.6 |
| 3,181,000 | 4/1965 | Siegel et al. | 91/433 X |
| 3,225,544 | 12/1965 | Lemly | 60/404 |
| 3,330,531 | 7/1967 | Slator et al. | 91/420 |
| 3,680,311 | 8/1972 | Harbonn et al. | 60/404 |
| 3,776,101 | 12/1973 | Nussbaumer | 91/420 X |
| 3,780,623 | 12/1973 | Hohlein | 91/461 X |
| 3,850,082 | 11/1974 | Nussbaumer | 91/5 X |
| 3,918,349 | 11/1975 | Nussbaumer | 91/5 |

FOREIGN PATENT DOCUMENTS

| | | | |
|---|---|---|---|
| 878,735 | 10/1942 | France | 91/5 |
| 1,347,264 | 2/1974 | United Kingdom | 251/26 |

*Primary Examiner*—Irwin C. Cohen
*Attorney, Agent, or Firm*—Pravel, Wilson & Gambrell

[57] ABSTRACT

A control system for controlling the operation of a valve actuator. The system includes a control valve for conveying operating fluid to the actuator in response to an actuator control signal. A single conduit operably connected to the actuatcr control valve both supplies operating fluid to the control valve and conveys an actuator control signal to the control valve.

3 Claims, 4 Drawing Figures

ACTUATOR CONTROL SYSTEM

BACKGROUND OF THE INVENTION

The field of this invention is actuator control systems and the like.

Valve actuator control systems are frequently employed with fluid handling networks to control the operation of actuators which open and close valves in the network.

So far as is known, actuator control systems typically included a supply line to supply operating fluid or power and one or more signal lines separate and apart from the supply line to convey control pressure or signals. Upon receipt of the control signals, a valve in the control system directed fluid from the supply line to the actuator to move the actuator.

These are disadvantages to these control systems. One such disadvantage was that the supply line had to be large enough to supply sufficient quantities of operating fluid at a rate to achieve the desired speed of operation of the actuator. Providing these large supply lines increased the cost of the control system. Further, in some of these systems, if the supply line was broken or otherwise failed, the control systems were without fluid to operate the actuator. Also, if the signal line was broken or otherwise failed, there was no way to transfer control signals to the actuator to ensure that the valve operated by the actuator was in the proper position.

SUMMARY OF THE INVENTION

It is an object of this invention to provide a new and improved actuator control system.

Generally, the actuator control system of the present invention includes an actuator control valve for controlling the movement of the double acting actuator between an open position and a closed position in response to an actuator control signal. A single conduit connected to the actuator control valve supplies fluid under pressure to provide both operating fluid and a control signal to the actuator control valve. Thus, the single conduit supplies both operating fluid and a control signal for controlling the movement of the actuator with the actuator control valve. The separate signal line of known control systems is eliminated, and there is no signal line external to the present actuator control system which must be secured against adverse conditions such as fire, explosion and the like.

A reserve fluid source is also provided to supply the actuator operating fluid to the control valve upon interruption of the fluid supply from an external source connected to the conduit. In this manner, the actuator control valve is supplied with fluid for operating the actuator despite the interruption of the fluid supply from the external source. Further, since the actuator operating fluid is supplied by the reserve fluid source upon the interruption of the fluid supply from an external source, the movement of the double acting actuator effected by the actuator control system of the present invention is independent of the size of the supply line from the external fluid source. Only the elements of the control system itself need be sized to provide an adequate flow of fluid to the double acting actuator to achieve the desired actuator operation speed.

With a first embodiment of the present invention, structure is provided so that a double acting actuator is moved to either an open position or a closed position in response to certain preselected fluid network conditions. In a second embodiment of the present invention, structure is also provided for moving the double acting actuator to either an open or a closed position in response to certain fluid network conditions. Additionally, the second embodiment of the present invention is provided with structure for holding the double acting actuator in the selected position. A manual reset operator is provided on the control valve to permit the actuator position to be reset manually. A third embodiment of the present invention is particularly adapted for use with a regulated external fluid source which alternately supplies the fluid to either of two inlet ports. This third embodiment of the present invention provides structure by which the double acting actuator is retained in its position immediately prior to the occurrence of certain preselected fluid network conditions represented by the actuator control signal.

DETAILED DESCRIPTION OF THE PREFERRED EMBODIMENT

Figure 1:
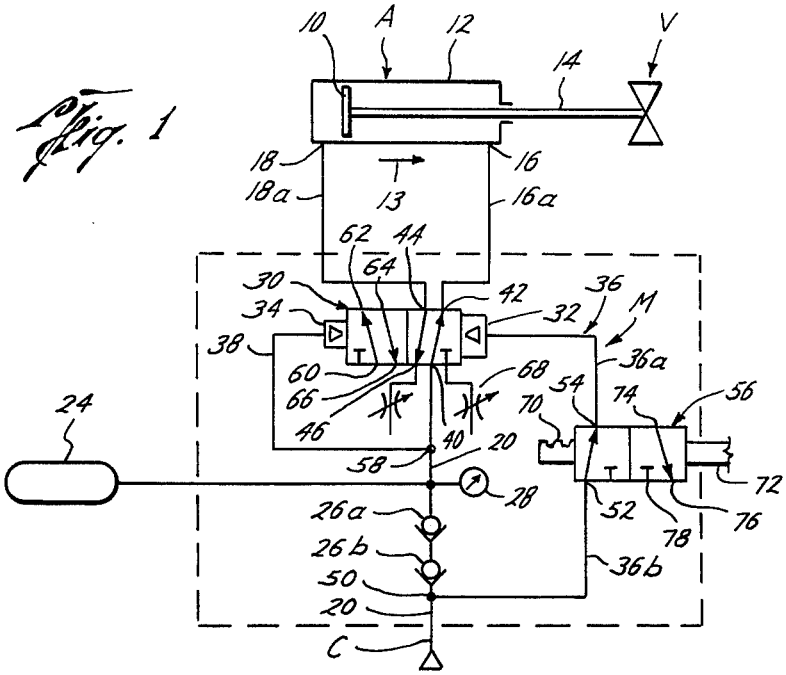
FIG. 1 is a schematic fluid power diagram of the actuator control system of the present invention.

In the drawings, the letter S designates generally the actuator control system of the present invention for controlling the movement of a double acting actuator A which, in turn, opens and closes a valve V in a fluid handling network. The actuator control system S includes an actuator control means M for controlling the movement of actuator A between an open position and a closed position in response to an actuator control signal. A single conduit means C operably connected to the control means M both supplies actuator operating fluid to the actuator control means M and conveys an actuator control signal to the control means M. The operating fluid may be air, hydraulic fluid, natural gas, nitrogen, water or some other suitable fluid media.

In the accompanying drawings, the various components of the system S are set forth in accordance with American National Standard ANS Y 32.10, "Graphic Symbols for Fluid Power Diagrams", and thus are in a form well known and understandable to those of ordinary skill in the art.

Considering the invention in more detail, FIG. 1 illustrates a first embodiment of control system S for controlling the movement of the double acting actuator A to move the valve V to a closed position in response to a control signal indicating an interruption in the fluid supply from external source (not shown). The actuator A is a conventional, double acting actuator having a piston 10 mounted for longitudinal movement within an actuator housing 12. An actuator shaft 14 is operably connected between the piston 10 and the valve V so that when the piston 10 moves, the valve V is opened or closed, depending upon the direction of movement of piston 10 within the actuator housing 12. Actuator A is in an open position with piston 10 in the position illustrated in FIG. 1. In this open position, valve V is open, but when piston 10 moves with respect to housing 12 in the direction of an arrow 13, the actuator A moves valve V to a closed position.

Actuator A additionally includes two ports 16 and 18 in fluid communication with the actuator control means M through actuator connecting means 16*a* and 18*a* for receiving operating fluid from the control means M. The direction of movement of piston 10 is dependent upon the port through which operating fluid is introduced into the actuator A. When operating fluid is introduced through port 16, the fluid acts on piston 10 and moves the piston 10 to the open position illustrated in FIG. 1. However, if fluid is introduced through port 18, the fluid acts on piston 10 to move the piston in the direction of arrow 13, and the actuator A moves to a closed valve V.

Actuator A is supplied with operating fluid through actuator control means M which, in turn, is supplied with fluid through conduit C which is operably connected to an external fluid source (not shown). Supply line 20 is additionally in fluid communication with a reserve fluid source 24 to provide operating power to move the piston 10 of actuator A, as will be set forth.

A pair of check valves at 26*a* and 26*b* are also provided in the conduit C to ensure that actuator operating fluid stored in the fluid source 24 does not escape into the conduit C when pressure is abated in the conduit C to form the actuator control signal, as will be set forth. The first check valve 26*a* may be a resilient check valve which is particularly leak resistant, and the second check valve 26*b* may be a metallic or hard seating valve which is particularly resistant to temperature fluctuations. It should be understood, however, that both check valves are not absolutely required. Rather, one check valve of either type is sufficient for the operation of control system S.

While any suitable reserve fluid source may be used with the present invention, preferably reserve source 24 is a fluid storage tank which is charged by fluid flowing through conduit C from the external fluid source. If desired, a pressure gauge 28 may be provided, as shown, in fluid communication with supply line 20 to indicate the fluid pressure in the line 20 and thereby provide a visual display indicating when the reserve storage tank 24 has been completely charged by the fluid flowing from the external source through the supply line 20.

As illustrated in FIG. 1, the actuator supply means M includes the control valve 30 having a differential fluid pressure return operator illustrated as sensing ports 32 and 34. Sensing port 32 is in fluid communication with a first signal line 36, and sensing port 34 is in fluid communication with a second signal line 38. As described in more detail hereinbelow, the first and second signal lines 36 and 38 convey a fluid pressure actuator control signal to the sensing ports 32 and 34, and the control valve operator moves the valve 30 between an opening position and a closing position to control the direction of fluid flow to actuator A in response to the actuator control signal.

With the control valve 30 in the opening position illustrated in FIG. 1, the conduit C is in fluid communication with an inlet port 40 of valve 30 so that operating fluid flows through the inlet port 40, a connecting valve outlet port 42, actuator connecting line 16*a*, and actuator port 16 where the fluid is introduced into the actuator A to force or maintain the actuator piston 10 in an open position. Actuator port 18 and connecting line 18*a* communicate with an inlet port 44 and an outlet port 46 of valve 30 to form a return line or exhaust line venting fluid present in the chamber of cylinder 12 through adjacent port 18. Additionally, valve outlet port 46 may be provided with a variable orifice 48 for restricting the flow in the return line and thereby controlling the speed with which the actuator piston 10 is moved. Other means of flow control may be used such as an orifice in line 18*a* or line 20.

So long as fluid at an acceptable operating pressure is supplied through an inlet 22 from the external source, the control valve 30 remains in the opening position, and fluid from the external source is supplied through conduit C and valve 30 to the port 16 of actuator A to move the actuator piston 10 to an open position and maintain the piston 10 in that open position. When the fluid supply from the external source is interrupted either intentionally or by way of equipment malfunction, thereby forming the control signal transmitted over conduit C, as will be set forth, however, the elements of control system S operate to close the actuator A and the valve V.

The first signal line 36 has a lower leg 36*b* which is in fluid communication at a point 50 upstream of the check valves 26*a* and 26*b*. The lower leg 36*b* of the first signal line 36 is in fluid communication with sensing port 32 through an inlet port 52 and an outlet port 54 of a test valve 56 and an upper leg 36*a* of the signal line 36. The first signal line 36 conveys fluid from the upstream point 50 of supply line 20 to the sensing port 32. The fluid so conveyed to sensing port 32 is at a pressure substantially equal to the pressure in conduit C at the upstream point 50. This fluid at sensing port 32 provides a first part of the actuator control signal for controlling the operation of control valve 30.

A second part of the actuator control signal is conveyed to sensing port 34 of valve 30 by a second signal line 38. The second signal line 38 is in fluid communication with supply line 20 at a point 58 downstream of the check valves 26*a* and 26*b*. The second signal line 38 thus conveys to the sensing port 34 a fluid which is at a pressure substantially equal to the pressure in supply line 20 downstream of the check valves 26*a* and 26*b*. The reserve fluid source 24 is additionally in fluid communication with this downstream point 58 of supply line 20. As previously noted, the reserve fluid source is charged by the fluid flowing through line 20 from the external source and, after charging, retains fluid at a pressure substantially equal to the normal operating fluid pressure of the external fluid source. The reserve fluid source 24 thus provides fluid at the normal operating pressure to the downstream side of the supply line 20. Consequently, the second part of the actuator control signal conveyed to outlet port 34 is a fluid at a pressure substantially equal to the normal operating fluid pressure of the system S.

When the fluid supply by conduit C from the external source is interrupted, either intentionally or by accident, the fluid pressure exerted on sensing port 32 through signal line 36 is less than the fluid pressure continuously exerted on sensing port 34 through signal line 38 from source 24. This difference in pressure at the sensing ports 32 and 34 causes the differential pressure operator of control valve 30 to move the valve 30 to a closing position so that fluid is directed through valve 30 in a direction which closes the actuator A. The supply line 20 is brought into fluid communication with a valve inlet port 60 which communicates with connecting line 18*a* and actuator port 18 through a valve outlet port 62. Additionally, actuator port 16 and connecting line 16*a* are brought into fluid communication with an inlet port 64 and an outlet port 66 of control valve 30 to form a return or exhaust line. A variable orifice 68 may also be provided in fluid communication with outlet port 66 to control the fluid flow rate in the return line and thereby control the speed of operation of actuator A. Thus, when valve 30 is in its closing position, operating fluid is supplied from the reserve fluid source 24, through supply line 20, valve 30, and connecting line 18*a* to actuator port 18. Fluid introduced through the actuator port 18 forces the actuator piston 10 in the direction of arrow 13 to force the piston 10 into a closed position and maintain it in that position.

When a fluid supply is reestablished through the inlet port 22, the fluid pressures exerted on pressure sensing ports 32 and 34 through signal lines 36 and 38 are substantially equal, and the valve operator returns the control valve 30 to the opening position illustrated in FIG. 1, since actuator 32 is physically larger than actuator 34. However, it is advisable that the reserve tank 24 be sufficiently large to contain enough fluid for the desired number of successive closings, which may often be two or more, of the actuator A in case the restoration of the fluid supply through inlet 22 is temporary in nature and it is subsequently necessary to once again close the actuator A.

The system S is also provided with a testing valve 56, for testing the functioning of the system. As previously indicated, valve 56 is normally in a position illustrated in FIG. 1 so that the upper leg 36*a* in the lower leg 36*b* of the first signal line 36 are in fluid communication with one another through the inlet port 52 and outlet port 54 of the test valve 56. The valve is normally retained in this operating position by a detent 70 operably connected to the valve. However, test valve 56 is also provided with a manual operator 72 for overriding detent 70 so that the valve is moved to a blocking position in which the lower leg 36*b* of the signal line 30 is in communication with a blocking port 78 for blocking fluid flow through the lower leg 36*b* of signal line 36. In this blocking position, the upper leg 36*a* of the signal line 36 is placed in fluid communication with an inlet port 74 for bleeding pressurized fluid from the upper leg 36*a* through a valve outlet port 76. Moving the test valve 56 to this blocking position effectively simulates the loss of a fluid supply through conduit C. Pressure sensing port 32 does not receive a fluid under pressure, but the second signal line 38 continues to provide a fluid under pressure from the conduit C to sensing port 34. Accordingly, the differential pressure operator of control valve 30 moves valve 30 to the closing position in which fluid from reserve tank 24 is introduced through actuator port 18 to close the actuator.

Restoration of the test valve 56 to its normal position providing communication between the upper leg 36*a* and the lower leg 36*b* of the first signal line 36 restores the fluid communication provided between the conduit C and the pressure sensing port 32 to cause the control valve operator to move the control valve 30 to the opening position so that it once again conveys actuator operating fluid to the actuator port 16 of the actuator to open the actuator A and valve V.

Thus, it can be seen that test valve 56 provides a means for testing the operation of the control system S without having to disconnect the control system from the fluid supply through inlet 22. It should be understood, however, that the test valve 56 although desirable is not required for satisfactory operation of the system S. The first signal conduit branch 36 could be formed as a single line providing direct fluid communication at all times between the upstream side 50 of supply conduit branch 20 and the pressure sensing port 32. Test valve 56 may also be solenoid or pilot operated rather than manual. Also, it may, under certain circumstances, be desirable to use spring return rather than detent. Thus, a variety of operating means such as double solenoid, etc., may be used.

Figure 1A:
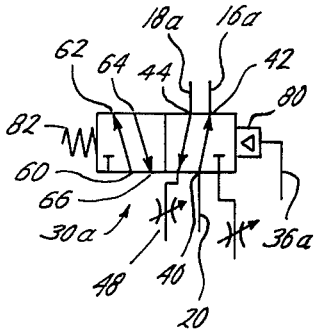
FIG. 1A is a schematic illustration of an alternative control valve suitable for use with the system of FIG. 1.

FIG. 1A illustrates an alternative control valve 30*a* which may be employed with the first embodiment of the present invention in lieu of the control valve 30 illustrated in FIG. 1. The alternative control valve 30*a* provides the same basic fluid passageways between the supply conduit branch 20 and the connectors 16*a* and 17*a* of actuator A, and it is to be provided in the system in a substantially similar manner to control valve 30. Accordingly, like numerals have been used in FIG. 1 and FIG. 1A to indicate like parts of the system S and the fluid passageways between the supply line 20 and the actuator A.

The alternative control valve 30*a* (FIG. 1A) has a pressure sensitive, spring biased operator 82 rather than the second pressure sensing port 34 of the valve 30*a* (FIG. 1). The upper leg 36*a* of the first signal line 36 is placed in fluid communication with a pressure sensing port 80 operably mounted with the valve 30*a*. A fluid pressure signal is conveyed to pressure sensing port 80 in a manner identical to that in which the signal was conveyed to pressure sensing port 32 of control valve 30. So long as fluid is supplied through inlet 22 at a suitable operating pressure, fluid is conveyed through the signal line 36 to the pressure sensing port 80, and the control valve operator maintains the valve 30*a* in its opening position illustrated in FIG. 1A. In this opening position, fluid communication is provided between the supply line 20 through inlet port 40 and outlet port 42 to connector 16*a* for the introduction of operating fluid through actuator port 16 so that the actuator A is maintained in an open position. However, when the fluid supply through inlet 22 is interrupted, pressure is relieved at pressure sensing port 80, and the spring bias member 82 of the valve operator moves valve 30*a* to its closing position to bring the supply line 20 into fluid communication with valve inlet port 60, valve outlet port 62, and actuator connector line 18*a* so that fluid is introduced through actuator port 18, and the actuator A is closed. Upon restoration of the fluid supply at inlet port 22, a pressurized fluid signal is again provided at pressure sensing port 80 to overcome the spring bias force of spring 82 and return the control valve 30*a* to its opening position in which fluid is directed to actuator A in a manner opening the actuator A and valve V.

Figure 2:
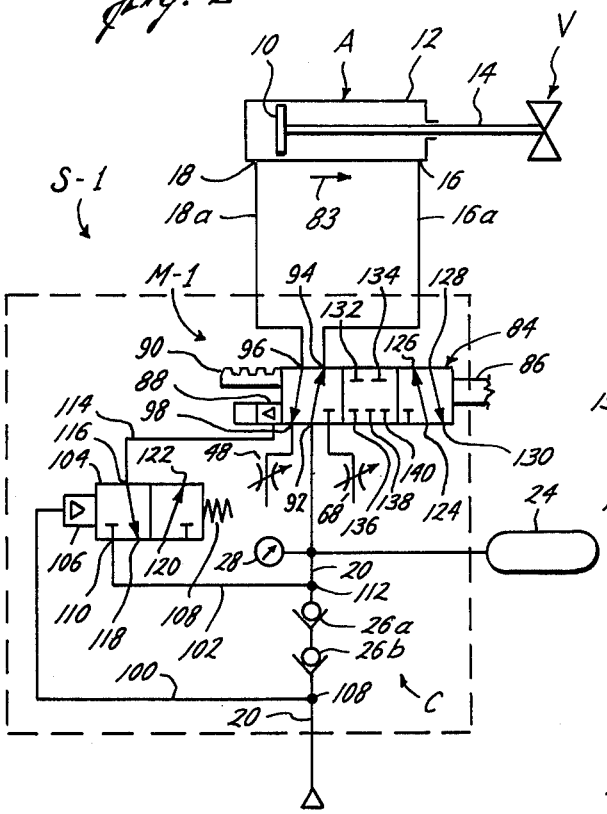
FIG. 2 is a schematic fluid power diagram of a second embodiment of the present invention.

FIG. 2 illustrates the second embodiment, actuator control system S-1, which not only closes the actuator A in response to a loss of fluid supply from an external source, but also requires a manual resetting of the control system S-1 to restore the actuator A to its open position. The system S-1 includes many elements performing the same functions performed by the corresponding elements described above with respect to the first actuator control system S. Accordingly, like numerals are used in FIG. 1 and FIG. 2 to indicate like elements.

The system S-1 includes a single conduit C for conveying fluid in the control means M-1. The actuator control means M-1 regulates the direction of flow of the operating fluid to control the movement of the actuator piston 10 between an open position illustrated generally in FIG. 2 and a closed position in which the piston 10 is moved longitudinally in the direction of an arrow 83. The actuator control means M-1 includes a control valve 84 with a pressure sensitive, manual reset operator for moving valve 84 between opening, blocking and closing positions. The operator is illustrated schematically in FIG. 2 by a manual operator 86, a pressure sensitive port 88, and a detent 90, the operation of which is described hereinbelow.

When the fluid at a suitable pressure is supplied to the system S-1 and control valve 84 is in its opening position, fluid is conveyed through the check valves 26*a* and 26*b* and the conduit C to an inlet port 92 of control valve 84. The valve inlet port 92 is in fluid communication with a valve outlet port 94 which, in turn, is in fluid communication with connecting line 16*a.* In its opening position, the control valve 84 provides a fluid passageway between the conduit C and the actuator port 16 so that fluid received at inlet 22 is conveyed through system S-1 and into port 16 of actuator A to move or retain the actuator piston 10 in an open position. An exhaust or return line is also formed when the control valve 84 is in its opening position by the actuator port 18 and the actuator connector 18*a* in fluid communication with an inlet port 96 and an outlet port 98 of the valve 84. A variable orifice 48 may also be connected to the valve outlet port 98 to vary the flow in this return or exhaust line and thereby regulate the speed with which actuator piston 10 is forced into an open position.

The system S-1 is additionally provided with a first signal line 100 and a second signal line 102 for conveying fluid under pressure to a signal valve 104. The signal valve 104 has a pressure sensitive, spring or differential pressure biased operator, and the first signal line 100 is in fluid communication with conduit C at a point 108 upstream of check valves 26*a* and 26*b.* The first signal line 100 thus conveys a fluid from the upstream pint 108 of conduit C to the pressure sensing port 106, and the fluid conveyed to sensing port 106 by the signal line 100 is at a pressure substantially equal to the pressure in conduit C upstream of the check valve 26*a* and 26*b.* So long as a supply of fluid at an appropriate pressure is present in conduit C, the pressurized fluid transmitted by signal line 100 to sensing port 106 overcomes an opposing force exerted by a spring biased operator member 109 operably mounted with signal valve 104, and the signal valve 104 remains in its operating position illustrated in FIG. 2. In this operating position, the second signal line 102 is connected to a blocking port 110 of the signal valve 104. The signal line 102 is additionally in fluid communication with the conduit C at a point 112 downstream of the check valves 26*a* and 26*b.* However, no fluid flows from the conduit C through the signal line 102 so long as signal valve 104 is in its operating position because the blocking port 110 of the signal valve 104 prevents fluid flow through the signal line 102.

A signal connecting line 114 is also operably connected to signal valve 104 and provides a fluid passageway between the signal valve 104 and the sensing port 88 of the control valve 84. When the signal valve 104 is in its operating position as illustrated in FIG. 2, the sensing port 104 serves as a bleeder valve for the signal connecting line 114. The signal connecting line 114 is in fluid communication with a valve inlet port 116 and a connecting valve outlet port 118 which provides a flow passage through which any pressurized fluid in the signal connecting line 114 is bled from that line.

So long as fluid is supplied at an appropriate pressure through conduit C, the first signal line 100 conveys pressurized fluid to sensing port 106 at a pressure sufficient to maintain the sensing valve 104 in its operating position. However, when the fluid supply is interrupted, an insufficient fluid pressure is maintained at pressure sensing port 106 to keep the signal valve 104 in its operating position. Instead, the force exerted by spring bias operator 108 moves the signal valve 104 into a signal conveying position in which different valve ports are operably connected to both the second signal line 102 and the signal line connector 114. In this signal conveying position of signal valve 104, the second signal line 102 is brought into fluid communication with an inlet port 120 of the signal valve 104, and the signal connector line 114 is brought into fluid communication with a connecting valve outlet port 122 so that a continuous fluid passageway is formed between the reserve tank 24 and sensing port 88 of control valve 84. Since the downstream point 112 of the supply line 20 is in fluid communication with the reserve tank 24, the fluid passageway formed by the signal conduit line 102, signal valve 104, and signal connector line 114 conveys a fluid under pressure to the control valve sensing port 88.

This pressurized fluid provided to the pressure sensing port 88 is an actuator control signal which causes the operator of the control valve 84 to move the control valve 84 to its closing position. In this closing position, the supply line 20 is brought into communication with a valve inlet port 124 which, in turn, communicates through an outlet port 126, actuator connector 18*a,* and actuator port 18 to supply fluid from reserve tank 24 to the actuator port 18. Fluid is thus introduced through actuator port 18 and exerts a force on actuator piston 10 to move the piston in the direction of the arrow 83 for closing the actuator A and the valve V. A vent or exhaust line is formed by control valve 84 in its closing position by providing fluid communication between actuator port 16, connecting line 16*a,* a valve inlet port 128 and a corresponding valve outlet port 130. A variable orifice 68 may also be connected to the valve outlet port 130 to vary the flow in this return or exhaust line and thereby regulate the speed with which the actuator piston 10 is forced into a closed position. Thus, in response to the loss of the fluid supply from conduit C, an actuator control signal is provided to control valve 84 by signal valve 104, and the control valve 84 moves to its closing position and closes the actuator A and the valve V.

Upon restoration of the fluid supply in conduit C, fluid at a pressure is once again supplied to the pressure sensing port 106 of signal valve 104 by the first signal line 100. This pressurized fluid at sensing port 106 causes a signal valve 104 to return to its operating position in which signal connecting line 114 is bled and fluid flow through the second signal line 102 is blocked. As a result, no fluid under pressure is then supplied to the sensing port 88 of control valve 84. However, control valve 84 is not then returned to its open position because of the movement of signal valve 104 to its operating position. Once the valve 84 is moved to its closing position by the sensing port 88, detent member 90 retains the valve 84 in its closing position, and the valve 84 continues to supply fluid to the actuator port 18 to maintain the actuator in its closed position. To move the control valve 84 to its opening position after an interruption of the supply of fluid through inlet 22, a manual reset operator 86 is provided. Personnel using the system S-1 may move the manual operator 86 to override the detent member 90 to return the control valve 84 to its opening position. Thus, the control valve 84 is not automatically returned to its opening position because the restoration of a fluid supply at inlet 22, but requires a manual resetting. The control valve 84 remains in its closing position, and the actuator A and valve V remain closed until the manual reset operator 86 is utilized.

Two additional functions of manual operator 86 should also be noted. First, the manual operator 86 provides a means by which control valve 84 may be moved to its blocking position. In this blocking position, each of the fluid carrying members operably mounted for connection with the control valve 84 is brought into fluid communication with one of the blocking ports 132–140 which collectively block the flow of fluid in either direction through the control valve 84. With the control valve 84 thus blocking the fluid flow between the system S and the actuator A, the actuator A and valve V may be removed from the system S without having to disconnect inlet 22 from the external fluid source and without having to bleed the reserve storage tank 24. Secondly, manual operator 86 also serves as a testing element. By use of the manual operator, control valve 84 may be moved from its opening position to its closing position to simulate the loss of the fluid supply at inlet 22. Also, where the blocking function is not required, valve 84 need not include blocking ports therein.

Figure 3:
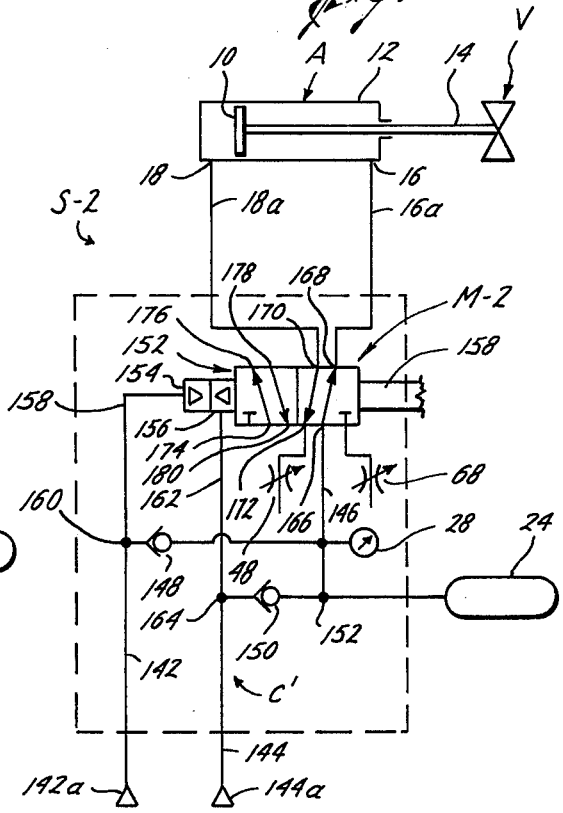
FIG. 3 is a schematic fluid power diagram of a third embodiment of the present invention.

FIG. 3 illustrates a third embodiment, actuator control system S-2 which provides structure for retaining the actuator A in its same position as it was in immediately prior to the interruption of a fluid supply from an external source. Additionally, the system S-2 is particularly adapted to use with a regulated external fluid source which alternatively supplies fluid to either of two inlet ports. The third embodiment of system S includes many of the same elements for performing the same function performed by corresponding elements described above with respect to the actuator control system S and S-1. Accordingly, like numerals are used in FIG. 1, FIG. 2 and FIG. 3 to indicate like elements.

The actuator control system S-2 includes a first supply conduit branch 142 and a second supply conduit branch 144 having inlets 142*a* and 144*a*, respectively. The inlets 142*a* and 144*a* are provided for connection to a regulated external fluid source (not shown) which alternatively supplies fluid through either of the supply conduit branches 142 or 144. That is, the regulated external fluid source provides fluid through one of the supply conduit branches 142 and 144, and the supply conduit branch not used for supplying fluid serves as an exhaust conduit for the regulated source. However, either of the conduits 142 and 144 may be used for supplying fluid, and either of the conduits may be used for forming an exhaust line to the regulated source.

Both the supply conduit branches 142 and 144 are operably connected to a common supply line 146 in the actuator control means M-2. The first supply conduit branch 142 is connected to the common supply line 146 through a check valve 148, and the second supply conduit branch 144 is similarly operably connected to the common supply line 146 through a check valve 150. Both the check valves 148 and 150 ensure that a fluid flow in the respective supply conduit branches is only toward a control valve 152 of control means M-2. However, since both the supply conduit branches 142 and 144 are operably connected to the common supply line 146, operating fluid from the external source is conveyed to the common supply line 146 regardless of which of the supply conduit branch serves as the conduit C conveying fluid from the external source. Additionally, the reserve fluid tank 24 is in fluid communication with the common supply line 146 at a point 152 downstream of both check valves 148 and 150. Accordingly, the reserve tank 124 is charged by the fluid introduced into common supply line 146 from either of the supply branches 142 or 144.

The actuator control means M-2 includes the control valve 152 having two pressure operators, shown schematically in FIG. 3 by the sensing ports 154 and 156, and a manual operator 158. The sensing ports 154 and 156 provide a means by which the control valve 152 is moved between an opening position and a closing position in response to the particular supply branch conveying fluid to the system S from the external source. Pressure sensing port 154 is operably connected to a first signal line 158. This first signal line 158 is, in turn, operably connected to the first supply branch 142 at a point 160 upstream of the check valve 148 in the first supply branch 142. The first signal line 158 thus provides a means for conveying fluid to the pressure sensing port 154 at a pressure substantially equal to the fluid pressure in the first supply branch 142. Similarly, pressure sensing port 156 is operably connected to a second signal line 162. This second signal line 162 thus provides means for conveying fluid under pressure to the sensing port 156, and the fluid so conveyed is at a pressure substantially equal to the fluid pressure in the second supply conduit branch 144.

FIG. 3 illustrates the control valve 152 in its opening position with the second supply conduit branch 144 supplying fluid to the control valve 152. As shown, the first supply conduit branch 142 serves as the exhaust line for the external regulated source. In this position, fluid at an acceptable operating pressure is supplied to inlet 144*a*, through the second supply conduit branch 144, check valve 150, common supply line 146, a valve inlet port 166, a connecting valve outlet port 168, and actuator connecting line 16*a* to actuator port 16. A return or exhaust line from the actuator A to the control valve 152 is provided through actuator port 18, connecting line 18*a*, a valve inlet port 170, and a valve outlet port 172. The variable orifice 48 may be connected to the valve outlet port 172 to control the flow in the return line and thereby control the speed of operation of actuator A. In any case, the fluid introduced through port 16 of the actuator A retains the actuator in its open position so that the valve V is also maintained in an open position.

With fluid supplied through the second supply conduit branch 144, the second signal line 162 conveys a fluid to sensing port 156 at a pressure which is substantially equal to the fluid supply pressure from the external source through the second supply conduit branch 144. When the first supply conduit branch 142 is venting and serving as an exhaust line for the external force, the sensing port 154 does not receive a fluid under pressure through the first signal conduit 158. The pressure at pressure sensing port 156 and the lack of pressure at pressure sensing port 154 causes the pressure operator to retain the control valve 152 in its opening position. When equal pressure, or no pressure, is applied simultaneously to both sensing ports 154 and 156, the control valve 152 remains in the last position to which it has been moved.

However, when the fluid is supplied to the control system S-2 through the first supply conduit branch 142, and the second supply conduit 144 is venting and serving as an exhaust line, pressure sensing port 156 does not receive the fluid under pressure from the second signal line 162. Rather, the first signal line 158 conveys pressurized fluid to sensing port 154 and causes the pressure operator of control valve 152 to move the control valve to a closing position. In this closing position, fluid received at the inlet 142*a* passes through the first supply conduit branch 142, check valve 148, common supply line 146, a valve inlet port 174, a connecting valve outlet port 176, and connecting line 18*a* so that fluid is introduced from the external supply to actuator port 18. A return line is formed by the control valve 152 in its closing position through actuator port 16, connecting line 16*a*, valve inlet port 178, and a corresponding valve outlet port 180. A variable orifice 68 may be provided at the outlet port 180 to control the flow in the return line and thereby regulate the speed of closing of the actuator A. In any case, when control valve 152 is in its closing position, fluid is introduced into actuator port 18 to close the actuator A and the valve V.

The third control system S-2, upon an interruption of the fluid supply from the external regulated source, thus retains the actuator A in the position the actuator occupied immediately prior to interruption of the fluid supply. When fluid at an acceptable operating pressure is not received through either inlet 142*a* or 144*a*, actuator operating fluid flows from the reserve tank 24 and to the control valve 152 through the common supply line 146. Check valves 148 and 150 prevent the reserve tank fluid from flowing upstream toward the supply conduit branches 142 and 144. Additionally, since no pressure is sensed by either sensing port 154 or 156 when there is no pressurized fluid flowing through the supply conduit branches 142 and 144, the pressure operators do not move control valve 152 between the opening and the closing position of the valve, but permit the valve to retain its last position. Since actuator operating fluid is applied to the control valve from the reserve tank 24 and since the control valve 152 retains the position it occupied prior to the interruption of the fluid supply from the external source, fluid is passed from the reserve tank 24 to the actuator A to retain the actuator A in the position it occupied immediately prior to the interruption of the fluid supply from the external source.

It should be understood, of course, that many variations in the utilizations of the actuator control systems S, S-1 and S-2 are possible without departing from the spirit of the invention herein disclosed. For example, in the description above, where the control system S is described as opening or closing the actuator A in response to certan fluid supply conditions, the control system S may alternatively be used to move the actuator A in a position opposite of that described. By reversing connections of the actuator connecting lines 16*a* and 18*a* with the control valves, the direction of fluid flow between the control system S and the actuator A is reserved, and this reversal of the flow direction results in an actuator movement opposite that described with reference to the drawings. Additionally, it should be understood that the fluid used in the operation of the control system S may take a variety of forms. The control system S may be powered with plant air, instrument air, hydraulic fluid, natural gas, nitrogen, water, or other fluids. Additionally, since the control system S does not employ electricity for either power or control purposes, the system S eliminates much of the danger of explosion.

In short, the control system S provides numerous advantages over known actuator control systems. By using the common supply and signal conduit, the separate signal lines extending away from the control systems of known devices are eliminated so that there is at least one less external line in the control system S which must be secured against adverse conditions such as fire, explosion and the like. Additionally, this elimination of the external supply line facilitates encasing the control system S in containers which are resistant to these adverse conditions. Accordingly, the control system S provides effective actuator control, improves the security of fluid handling networks, and also reduces the expenditures required for the use of actuator control systems with the networks.

It should be understood that the valve V may be any suitable type of valve, such as gate valves, globe valves, plug valves, ball valves or butterfly valves.

Also, the valve V actuator may be of any double acting type using piston, pistons, diaphragm, diaphragms, or other means so long as it is double acting-that is to say, its opening and closing ports (one or more of each) are alternatively supplied and vented.

Also, one control system could operate more than one actuator, operating more than one valve simultaneously, or one operator could operate more than one valve. When more than one valve is being operated, some may be opening while some are closing, and vice versa.

The foregoing disclosure and description of the invention are illustrative and explanatory thereof, and various changes in the size, shape and materials as well as in the details of the illustrated construction may be made without departing from the spirit of the invention.

I claim:

1. A control system for controlling the operation of a valve, comprising:

a. a double-acting valve actuator having first and second portions for receiving operating fluid and being movable between a first position and a second position in response to fluid in said first and second portions, respectively;

b. a first fluid line connected to said first portion of said valve actuator for conveying fluid thereto;

c. a second fluid line connected to said second portion of said valve actuator for conveying fluid thereto;

d. single conduit means for supplying fluid under pressure to operate said valve actuator and also provide a control signal at a point thereof;

e. reverse fluid means connected to said single conduit means for accumulating fluid under pressure from the said single conduit means;

f. control valve means having an opening position and a closing position, comprising:

1. an inlet port and an outlet port conveying fluid under pressure from said single conduit means to said first fluid line when said control valve means is in the opening position;

2. an inlet port and an outlet port conveying fluid under pressure from said reserve fluid means to said second fluid line when said control valve means is in the closing position; and 3. pressure operator means responsive to the control signal to move said control valve means from the opening position to the closing position;

g. check valve means in said single conduit means interposed between said control signal point and said reserve fluid means; and h. said reserve fluid means being of a sufficient fluid capacity to provide for a plurality of successive movements of said actuator means between said first and second positions thereof without the addition of fluid thereto from said single conduit means.

2. The structure set forth in claim 1, wherein said control valve means includes:

a. means for connecting said first fluid line with the atmosphere in response to the control signal for expelling fluid through said first fluid line from said first portion of said actuator; and b. means for connecting said second fluid line with the atmosphere in the absence of the control signal for expelling fluid from said second portion through second fluid line.

3. The structure set forth in claim 2 further including test valve means for simulating the control signal from said conduit means whereby the operation of said control system may be tested.

* * * * *